US006487806B2

(12) United States Patent
Murello et al.

(10) Patent No.: US 6,487,806 B2
(45) Date of Patent: Dec. 3, 2002

(54) WEAPON HOUSING SYSTEM FOR AN AUTOMATIC LOADING FIREARM

(75) Inventors: Johannes Murello, Deisslingen (DE); Wilhelm Fischbach, Deisslingen-Laufen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/911,007

(22) Filed: Jul. 23, 2001

(65) Prior Publication Data

US 2002/0000059 A1 Jan. 3, 2002

Related U.S. Application Data

(63) Continuation of application No. PCT/EP00/00600, filed on Jan. 26, 2000.

(30) Foreign Application Priority Data

Jan. 28, 1999 (DE) ..... 199 03 328

(51) Int. Cl.[7] ..... F41A 21/00

(52) U.S. Cl. ..... 42/75.03; 42/75.01; 42/18; 42/33; 42/35; 42/6; 89/197; 89/132; 89/191.01

(58) Field of Search ..... 42/75.03, 75.01, 42/18, 22, 69.01, 33, 35, 37, 39, 6; 89/197, 125, 132, 9, 191.01

(56) References Cited

U.S. PATENT DOCUMENTS

| | | | | | |
|---|---|---|---|---|---|
| 2,503,596 | A | | 4/1950 | Rataiczak | 89/1 |
| 3,206,885 | A | | 9/1965 | Dye | 42/75 |
| 3,906,833 | A | * | 9/1975 | Orozco | 42/72 |
| 3,939,589 | A | * | 2/1976 | Tellie | 42/140 |
| 4,385,464 | A | | 5/1983 | Casull | 42/75 C |
| 4,562,659 | A | * | 1/1986 | Neta | 42/1.01 |
| 4,625,621 | A | * | 12/1986 | Warin | 42/1.09 |
| 4,654,993 | A | | 4/1987 | Atchisson | 42/71.01 |
| 5,513,461 | A | | 5/1996 | Weldle | 42/71.01 |
| 6,314,672 | B2 | * | 11/2001 | Murello et al. | 42/124 |

FOREIGN PATENT DOCUMENTS

GB 573 215 A 11/1945

OTHER PUBLICATIONS

*International Search Report* corresponding to International Patent Application Serial No. PCT/EP00/00600, European Patent Office, dated May 23, 2000, 4 pages.

*International Preliminary Examination Report* (and English–language translation) corresponding to International Patent Application Serial No. PCT/EP00/00600, International Bureau of WIPO, dated Jul. 31, 2001, 5 pages.

* cited by examiner

*Primary Examiner*—J. Woodrow Eldred
(74) *Attorney, Agent, or Firm*—Marshall, Gerstein & Borun

(57) ABSTRACT

A lightweight weapon housing system is disclosed for a self-loading firearm. The weapon housing includes an outer and an inner housing. A wall structure in the weapon housing reinforces the magazine chamber and transmits the transverse forces arising in the magazine into an inner housing, which suffers any resulting deformation and which can be exchanged in a simple manner should deformation result.

25 Claims, 2 Drawing Sheets

WEAPON HOUSING SYSTEM FOR AN AUTOMATIC LOADING FIREARM

RELATED APPLICATION

This patent claims priority under 35 U.S.C. §120 and is a continuation from co-pending International Patent Application Serial No. PCT/EP00/00600 which was filed on Jan. 26, 2000.

FIELD OF THE INVENTION

The invention relates generally to self-loading firearms, and, more specifically to a housing system for an automatic self-loading rifle or pistol.

BACKGROUND OF THE INVENTION

For a long time, self-loading rifles have possessed a component which receives a movable breech, which was either forged or machined out of a solid block. The machining for such a component, which formed a primary structural part, required a great expenditure of craftsmanship. On the outside of these breech sections were affixed many functional elements of the weapon. The practice of stamping weapon housings out of sheet metal did not start until the end of the thirties. These sheet metal housings could be fabricated much more quickly and less expensively than before, and yet surrounded most of the functional elements like a shell skeleton. The functional elements were also placed in the interior of the housing, and on this account were protected from damage and contamination. Sheet metal housings have, unfortunately, often been undesirably heavy, particularly with weapons of large dimensions. This weight problem is exacerbated when a particular zone must be reinforced, which usually was carried out by welding on reinforcing members.

Recently, to reduce the weight of the weapons, weapon housings have been made of plastic. In the zones exposed to the principle stresses, however, metal sheathing is once again being used, thereby drastically increasing the weight of the weapon.

For utility weapons, such as are employed for military or police applications, the design effort has been toward weapons of the least possible weight.

One of the main loading factors for the weapon housing is the abutment support of the closure spring of the breech. Fortunately, the spring forces of the breech closure act in the longitudinal direction of the housing, and are therefore well transmitted to the housing walls surrounding the breech spring. More dangerous for the structural strength of the housing, however, is a possible deformation which may be caused by the magazine. The magazine forms a long, lever arm, extending out of the housing from the magazine chamber. This chamber is constructed in the housing and, in the most simple case, is principally an opening, which corresponds to the cross-section of the magazine.

The cross-section of the opening must be large enough to fit the lengths of the provided cartridges. Therefore, the longer the cartridge, the longer the cross-section of the opening must be, which makes the housing more susceptible to twist, since the opening of the magazine chamber breaks the structural advantage of the closed box cross-section of the housing. In order to provide the area of this opening with greater structural strength, the opening is typically encased with a wall structure, which then borders the opening.

This stiffening measure, however, has not always been sufficient. This is particularly the case, when the magazine protrudes out of the housing, and when this protrusion is of a substantial length. In such a case, a more or less transverse loading on the free end of the magazine can lead to the imparting of very high forces to the magazine chamber. This can occur, for instance, if the weapon falls from the bed of a truck to the ground, and then, unfortunately, the magazine separates. An unreinforced, especially thin walled housing can then be bent or even develop fissures.

In the case of a large caliber, self-loading firearm designed for firing shell type munitions with a caliber of some 20 mm, due to the large cartridges which are employed, all parts are inordinately large and heavy. However, a given allowable weight for a user must not be passed. The difficulties arising from this body of problems are increased, when the large caliber rifle carries attached equipment, such as a rapid-fire-system.

The plastic housing of such a large caliber firearm, on this account must be as thin-walled as possible and can only contain the least possible number of metal accessories.

Consideration could be given to increasing the wall thickness in the area of the magazine chamber while refraining from any further metal additions. However, such a measure would be problematic from the standpoint of the casting process. In addition, an area of transition between a larger wall thickness to a lesser wall thickness can form a zone subject to especially great stress, which can lead to a specific location of failure.

In practice, an effort is made to lengthen the walls of the magazine chamber toward the free magazine end, in order, on the one hand, to diminish the lever advantage of the magazine, and on the other hand, to stiffen the housing opening of the magazine entry. In the case of modem rapid-fire weapons, in their conventional construction, (magazine in front of the grip piece) or in the "bull pup" fashion, (magazine behind the grip piece) the housing opening for the trigger mechanism is in immediate proximity to the magazine chamber. Additionally, this opening weakens the magazine section, so that the lengthening of the magazine chamber by itself is not enough to correct the above outlined problem in structural strength.

A self-loading rifle is known, from U.S. Pat. No. 4,654,993 where an outer shell construction has been provided so that many parts, such as the trigger mechanism, exhibit a double housing. This rifle, however, possesses no magazine chamber but rather shows complementary rails on the back of the magazine, such as on a retaining yoke made of steel.

Further knowledge gained from the manufacture of traditional repeating or single load rifles with wooden stocks (see, e.g., U.S. Pat. No. 4,385,464), cannot be brought to bear on the issues presented here, since in those cases no housing is present.

SUMMARY OF THE INVENTION

The interested reader is referred to the appended claim for concise descriptions of the inventive combinations. Independent claim 1 recites, a housing system for use with a self-loading weapon. The housing system includes a weapon housing having at least one wall at least partially encompassing a magazine chamber; and an inner housing located at least partially within the at least one wall. The inner housing at least partially encompasses at least a portion of the magazine chamber.

BRIEF DESCRIPTION OF THE DRAWINGS

All Figures show the same weapon housing system. The same reference numbers apply throughout for each element.

DESCRIPTION OF THE PREFERRED EMBODIMENTS

As used herein, expressions denoting position, such a "forward", "behind", "above", "vertical" or the like, refer to a weapon held in a normal firing position wherein the bore axis (the centerline axis of the barrel) runs horizontally and the direction of shooting is "forward".

Figure 1:
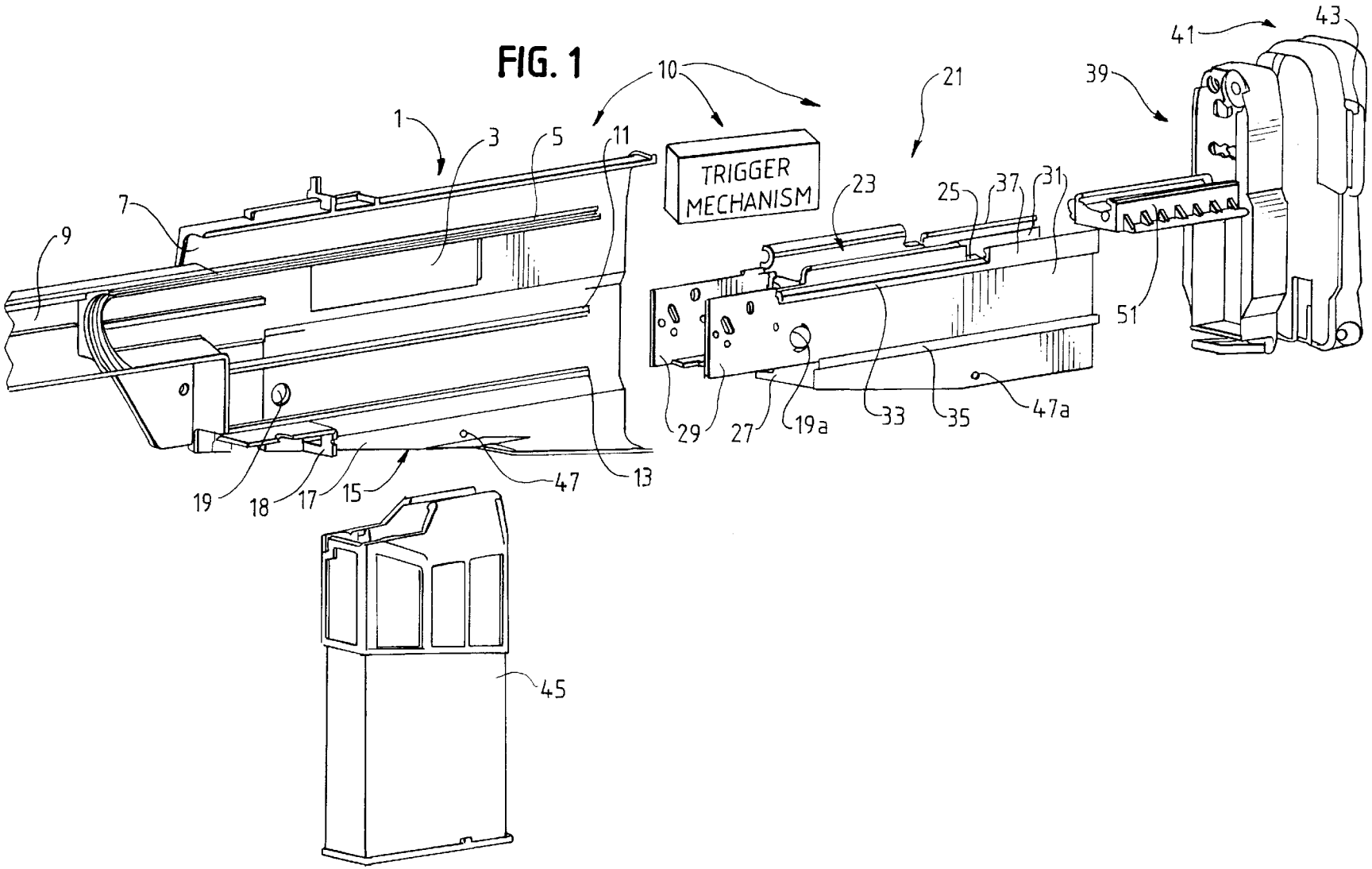
FIG. 1 is an exploded view in partial cross-section of a weapon housing system constructed in accordance with the teachings of the present invention, showing a magazine, an inner housing, a rear end closure cap, and a back up plate.

The weapon housing system 10 shown in FIG. 1 can be used in a self-loading rifle of the so-called bull pup design. Such weapons lack the usually conventional back stock, which is at the most distant rear end of the weapon housing 1 in other weapons. The back stock could also have been either integral with or attachable to the forward part of the rifle, and possibly shortened in its construction.

Lacking this back stock, in the depicted example the weapon housing terminates directly with the closure cap 39 or the backup plate 41. The magazine 45 seats itself then, as more or less a closure in front of the backup plate 41. The gripping piece of the weapon (not shown) is located in front of the magazine 45.

Figure 2:
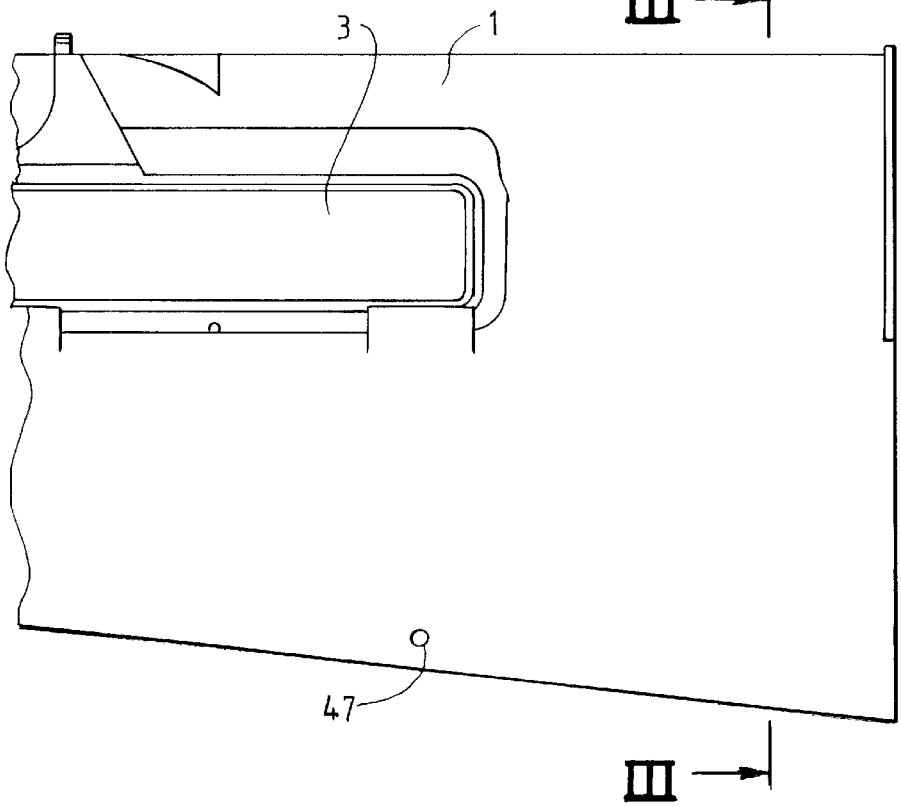
FIG. 2 is an enlarged side view of the rear section of the housing system of FIG. 1.

The weapon housing 1 exhibits a barrel sheathing 9 which extends itself forward. It also contains a guide strip 5 on its inner wall surface to align the breech (not shown). Adjacent to the movement path of the breech is an ejection window 3, which can be closed off by a dust cover. As a rule, such a weapon exhibits two windows of this type. The oppositely lying ejection window is shown in FIG. 2. In the normal arrangement, the ejection window 3 lies at the height of the cheek of the marksman. On this account safety measures must be upheld for the protection of the marksman from traumatic wounding. The safety measure in this example is that only the ejection window 3 on the opposite side of the weapon from the cheek of the marksman can be actuated. The normal or right handed marksman supports the weapon on the right shoulder and lays his right cheek against the left sidewall of the weapon housing 1. In this situation, for the reasons given above, only the right side ejection window 3 (visible in FIG. 1) may be activated. The left handed marksman, in contrast, can only activate the left side ejection window as seen in FIG. 2.

The construction of two, oppositely positioned ejection windows, leads to a structural weakening of the weapon housing 1. The weapon housing 1, could already be heavily subjected to stress at this location, because the magazine 45 is fastened under these ejection windows 3. Many transverse forces of considerable size could arise from the magazine 45. These forces can be introduced into the weapon housing 1, for example, when the weapon falls inadvertently from an elevated position to the ground. These transverse forces can bring about damaging, twisting deformations in the weapon housing 1, due to the zone weakened by the ejection windows 3.

The weapon housing 1 further possesses an opening 7, above the barrel sheathing 9. This opening 7 opens to the front for receiving a loading lever apparatus which is securely bound to the breeching and movable therewith. The rear side of the weapon housing 1 is open. The closure cap 39, which will be described in more detail below, is located in this opening. The backup plate 39, on its rear side, is covered from the outside by the backup plate 41. The backup plate 41 also serves as the shoulder piece, on the rim of which, there is attached one or, more preferably, two strap clasps 43.

The stresses introduced by the strap clasps 43 are transferred to the tough yet resilient closure plate 39, and via an appropriate fastening, are uniformly introduced into the weapon housing 1 through the peripheral structure of closure cap 39. In case of damage, only the closure cap 39 must be exchanged, not the entire weapon housing system.

The upper holding strip 11 and the lower holding strip 13 are located underneath and parallel to the breeching guide strips 5. The holding strips 11, 13 are constructed on the two side walls of the weapon housing 1. These strips are preferably resilient and spring toward the interior. They serve for the guidance and retention of an inner housing 21, described below. The strips 11, 13 also provide structural strength for the weapon housing 1.

On its underside, the box shaped weapon housing has a magazine opening 15. This opening 15 is bordered by one vertical forward wall 18 and two vertical sidewalls 17. The lateral bordering walls 17 comprise part of the side walls of the weapon housing 1. In front and above of the forward bordering wall 18, a bore 19 penetrates each side wall of the weapon housing 1. The bores 19 are aligned with one another to serve as a basis for the insertion of a fastening pin or a securing element (preferably a magazine securement or a bolting for a machine gun mounting).

The inner housing 21 is pushed into the weapon housing 1 from the back. To this end, each of the two sides of the inner housing 21 exhibits an upper counter holding strip 33 and a lower counter holding strip 35. The strips 33, 35 are parallel. The cross-sections of the counter holding strips 33, 35, are complementary to the cross sections of the above mentioned holding strips 11, 13. The holding strips 11, 13 are so constructed that they slidingly engage with the complementary counter holding strips 33, 35 in such a manner that the inner housing 21 is securely fixed in its elevated position, as illustrated in FIG. 3.

Figure 3:
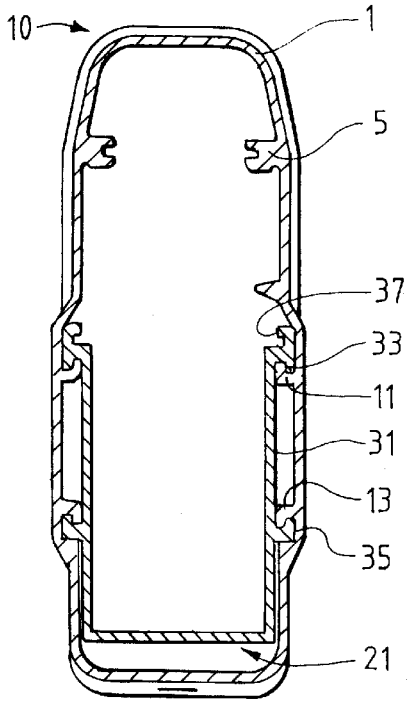
FIG. 3 is a cross-sectional view taken through section lines III—III of FIG. 2.

Thus, the lateral walls of the inner housing 21 together with the corresponding lateral walls 17 of the weapon housing 1 form a hollow box structural member, creating a highly bend and torque resistant construction (see FIG. 3).

The magazine chamber 23 is constructed in the inner housing 21 and is bordered at its forward extent by a vertical wall 27 and to the rear by a vertical back wall 25. When the inner housing 1 is in place, the forward wall 27 abuts flat against the border wall 18 of the weapon housing 1. The two bores 19*a* in the sidewalls of the inner housing 21 line up with the bores 19 of the weapon housing 1, and serve for the passage of a service element for the breech block as well as for the securement of the inner housing 21 within the weapon housing 1. Furthermore, the bores 47 in the side wall 17 of the weapon housing 1 and the bores 47*a* in the corresponding side walls of the inner housing 21 are aligned with each other, serving to accept pins or rivets, for effecting the fixation of the inner housing 21 in the weapon housing 1. The force transmission between the inner housing 21 and the weapon housing 1 is carried out in the forward direction by the already mentioned arrangement between the front cross wall 18 of the outer housing 1 and the front cross wall 27 of the inner housing 21. Force transmission between the inner housing 21 and the weapon housing 1 is carried out to the rear by the abutment of the inner housing 21 on the backup plate 41.

The side walls of the inner housing 21 are lengthened front to back by forward and rear extension walls, respectively, 29 and 31. The forward extension walls 29 (besides the discussed bores 19*a*) exhibit still more bores, which are intended for the connection of a trigger mechanism. A bottom plate, which binds the under edges of the two forward extension walls 29 together, reinforces the structure of the inner housing 21.

The elements of the trigger mechanism (shown generally in FIG. 1) cooperate with the bottom plate and the forward cross wall 27 of the inner housing 21 to substantially reinforce the box-like structure of the forward extension walls 29. The actuation of the trigger mechanism is done through a gripping piece or an attached device via a longitudinally movable rod or a finger. Such a device would be located under the barrel sheath 9. Preferably, the trigger mechanism possesses no element which projects from the bottom, not even a downward projecting trigger.

The two rear extension walls 31 of the inner housing engage the back-up plate 41. As may be inferred from FIG. 1, the groove/strip connections which are created by the complementary strip pairs 11, 33, and 13, 35, are considerably longer than the magazine 45, as seen in the longitudinal direction of the weapon. This measure leads to an effective structural strengthening of the side walls 17 over the entire rear section of the weapon housing 1.

If transverse forces are introduced from magazine 45 into the inner housing 21 and from this point on into the weapon housing 1, no critical loads are reached.

The backup plate 41 is pushed into the back end of the weapon housing 1, until it seats upon the rear exposed ends of the guide 5 and the strips 11 and 13. A massive longitudinal bridging 51 is installed on this backup plate 41. This bridging 51 is designed as a connecting rail that can be slidingly fitted into the upper edge structure 37 of the rear extension walls 31. In the assembled weapon, the forward exposed end of the bridging 51 overrides the rear cross wall 25 of the inner housing 21 and lies from the back against the magazine lips. As a result, the longitudinal bridging 51 can pick up the forces which the magazine 45 projects to the rear.

The upper side of the bridging 51 is designed as a guide for the cartridge slider. The upper edges of the sidewalls of the magazine chamber 23 are somewhat extended upward and rolled to the outside, so that they additionally support the corresponding side walls of the weapon housing 1.

The co-action between the weapon housing 1 and the inner housing 21 thus forms an especially strong and bend resistant magazine chamber. Some cross forces are primarily transferred into the inner housing 21 (which incidentally forms the actual magazine chamber 23), and are thereafter carefully distributed to the outer weapon housing 1. Therefore, the strips provide for the introduction of force, while at the same time they reinforce the weapon housing 1. They additionally aid in forming the cross pieces of the box structure, to which the sidewalls are extended.

Practically every element of the disclosed weapon housing system performs several functions so that, with few, thin-walled, largely or totally unreinforced plastic construction components, a surprisingly substantial, yet light weight housing has been created.

The depicted housing system can be constructed not only of plastic, but, with small modifications, also of sheet metal. As a result of its low weight and its high structural strength, this housing can be used for a rifle which fires high capacity cartridges (for example, a sharp shooting rifle for 0.50 Browning cartridges) at extended shooting distances.

From the foregoing, persons of ordinary skill in the art will appreciate that the disclosed weapon housing system 10 is comprised of at least two housings, with one housing encased within the other housing, thus establishing first, a weapon housing 1 and second an insertable inner housing 21 therewithin. The disclosed housing resists the stresses introduced by the magazine, while avoiding any significant increase in weight.

The weapon housing 1 is, of itself, well known. It is constructed of metal and/or plastic and includes at least a wall structure surrounding the magazine chamber 23.

The inner housing 21 has a box-like structure which is open at the top and bottom. The inside of the inner housing 21 forms the magazine chamber 23, or a part of the same. This box-like structure is within the weapon housing 1 and primarily accepts all stresses or, at least, the greater part thereof. With this construction, it becomes possible to affix this inner housing box to such points of the weapon housing 1, which are already otherwise reinforced or provided with strengthening. The usual requirement to provide separate reinforcement and structural support for the magazine chamber 23 may be omitted.

Preferably, this box-like structure (i.e., the inner housing 21), can be removed from the weapon housing 1. In the event that too great a load is applied to the magazine 45 and thereby transferred into the box-like structure, the box-like structure would preferably incur all the damage, and the weapon housing 1 would preferably incur none at all. The box-like structure can then be easily and inexpensively exchanged.

The disclosed weapon housing can be easily molded from plastic which permits a uniform housing wall thickness throughout.

It is possible that the inner housing 21 could cling close to the wall of the weapon housing 1 in the manner of a reinforcement layer. It is preferred, however, that a separating space, between the lateral walls of the weapon housing 1 and the walls of the inner housing 21 be maintained so that the space between the walls is compromised only at the fastening points between the inner housing 21 and the outer, weapon housing 1.

The wall of the inner housing 21, which borders the magazine chamber 23, and the proximal lateral wall of the weapon housing 1 which is specifically distanced, together form the equivalent of a structural member. In spite of light weight, such an arrangement obtains substantially greater structural strength than would be the case if the inner housing wall and the weapon housing 1 laid directly against one another. This arrangement will also be free from deterioration, if the components which surround the inner housing 21 are made of corrosion resistant material such as plastic.

The inner housing 21 could be secured within the weapon housing 1 in many ways, including, but not limited to, by welding or by adhesive. Preferably, however, bar-like strips define complementary grooves located on the inner surface of the weapon housing 1 (on the lateral walls thereof) and on the outside surface of the inner housing 21. These strips run in a longitudinal direction, so that the inner housing 21 can, preferably, be slidingly pushed into the main opening of the weapon housing 1 from the rear and be removed in the reverse manner.

The strips, which run in the longitudinal manner, extend themselves preferable over the entire length of the complete housing assembly. These members transmit the lateral bending forces arising at the free end of the magazine over the entire length of the strip/groove connection on the weapon housing 1. Preferably, the protruding members are continuous rail strips and are designed as forward springing rails themselves. These strips strengthen the inner housing 21 as well as the weapon housing 1. For the transmission of tension forces, the strip/groove combinations are also interlocked in such a manner that they transmit transverse forces in both directions.

The stressing of the weapon housing 1 is thus not carried out in an undefined manner over a large surface, but is strongly defined at the longitudinal strip/groove connections, which are best suited for accepting such a load.

Insofar as the already discussed spacing is present between the walls of the weapon housing 1 and the inner housing 21, the strip/groove connections a form the narrow dimensions of the so-constructed box-like structural member within the weapon housing system 10. The simple sliding of the inner housing 21 into the internal strips of the weapon housing wall enables the easy exchange of the inner housing 21. If precautionary concerns for the removal of the breech dictate that the inner housing 21 must necessarily be removed, then there arises a further safety aspect, such as when a field disassembly of the weapon is necessary. Using a conventional rifle, the marksman is occasionally so misled as to put his loaded magazine into the disassembled weapon, so that it is not dirtied or lost. In such a case, the danger arises of an involuntary loading of the weapon. Using the present design, however, this danger is excluded, because, in a disassembled rifle, the magazine 45 cannot be securely locked into the weapon housing 1. The inner housing 21 now forms the magazine chamber 23, as well as it secures the retention of the magazine 45 in the weapon.

A preferred construction is the lengthening of the forward side walls (where weapons of bull pup design are concerned) or the rear side walls (where weapons of conventional design are concerned) of the inner housing 21. Such lengthening forms among other advantages, a housing for the trigger mechanism.

In order to lessen the danger of dirt entering the trigger mechanism, it is customary not to allow the bearings of the individual axles or pins of the trigger mechanism to be set in the outer housing. The bearings are rather set in an individual trigger mechanism housing, which in turn is inset in the gripping stock.

In the disclosed device, since the inner housing 21 has been lengthened, then the projecting side walls of this inner housing 21 can perform the task of a trigger mechanism housing. The trigger mechanism is installed between the sidewalls, which at the same time provides additional structural strength for the inner housing 21. Further, the assembly of the trigger mechanism is made much easier, since this is done externally from the weapon housing 1. Therefore, the axles need not be additionally secured, because it is a part of the service of the housing wall.

If the inner housing 21 can be pushed into, as well as pulled out of, the weapon housing 1 from the back, then the trigger mechanism can likewise be installed and removed along with it, as long as this mechanism is not based on a trigger which projects from the bottom. In the latter case, the trigger mechanism would be contained in a component to be installed in the gripping piece, or, if necessary, in an additional apparatus yet to be added.

If the trigger mechanism possesses a transversely running safety shaft which is provided with an accessible outer knob, then this shaft or its knob can be placed in position later. In other words, it can be place in position following the insertion of the inner housing when the openings in the inner housing wall and the corresponding openings in the outer weapon housing wall are in alignment. The safety shaft, or pin, thus contributes to forming a reliable seating for the inner housing 21, since it penetrates both the inner and outer housings 21, 1.

Additionally, a forward detent can be provided, against which the inner housing 21 abuts and the inertial forces (in the case of a weapon falling upon the muzzle) are then absorbed by the inner housing 21.

In order to provide for a similar detent to the rear, at least the side walls of the inner housing 21 are lengthened in that direction. At the rear, the inner housing wall abuts the end cap 39 of the weapon housing system 10 (in the case of the bull pup design) or impinges against the rear stock in conventional weapons.

The inner housing 21, however, can also simultaneously form the end cap 39, (i.e. the rear stock abutment).

Preferably, the rear extending side walls are designed to consolidate together in a trough-like manner, and to seat themselves. As explained above, this results in a force transmitting, strip/groove connection with the outer weapon housing 1. In this way, a substantial increase is gained in the structural strength of the weapon housing system 10, as well as in the rigidity of the magazine chamber opening.

All of the above described designs of the inner housing 21 can be manufactured of sheet steel or of sheet steel reinforced plastic. It is also possible to employ fiber reinforced or prepreg reinforced plastics. The preference, however, is for non-reinforced plastic.

The inner housing 21 of non-reinforced plastic is seated in a weapon housing, which, at least in the area of the magazine, is likewise comprised of non-reinforced plastic. When the non-reinforced plastic magazine 45 is inserted and the weapon is fired, there practically exists three plastic-box structures, one inside the other, which can accept the loadings of the impact of the recoil without further support. When this happens, the plastic in certain areas, is elastically deformable, so that the surfaces subjected to force, which, unstressed, lie against one another with longitudinal corrugations, are pressed together in mutual surface engagement, so that damaging concentrations of force are avoided.

Although certain examples of apparatus constructed in accordance with the teachings of the invention have been described herein, the scope of coverage of this patent is not limited thereto. On the contrary, this patent covers all embodiments falling within the scope of the appended claims either literally or under the doctrine of equivalents.

What is claimed is:

1. For use with a self-loading weapon, a housing system comprising:

a weapon housing having at least one wall at least partially encompassing a magazine chamber; and an inner housing located at least partially within the at least one wall, the inner housing at least partially encompassing at least a portion of the magazine chamber, wherein the inner housing is offset a spaced distance from the at least one wall of the weapon housing.

2. A housing system as defined in claim 1, wherein the weapon housing and the inner housing contain complementary guide strips and guide grooves which locate the inner housing within the weapon housing.

3. A housing system as defined in claim 2 wherein the complementary guide strips and guide grooves are adapted to transfer forces from the weapon housing to the inner housing.

4. A housing system as defined in claim 1, wherein the inner housing includes side walls and the side walls of the inner housing extend forward to define a housing for a trigger mechanism.

5. A housing system as defined in claim 1, wherein the inner housing includes side walls, and the side walls of the inner housing extend rearward to engage the weapon housing.

6. A housing system as defined in claim 1, wherein the inner housing is plastic.

7. For use with a self-loading firearm having a magazine, a housing system comprising:

an inner housing defining a magazine chamber; and an outer housing surrounding the inner housing such that forces originating at the magazine are transferred from the inner housing to the outer housing, wherein the inner housing is offset a spaced distance from the at least one wall of the outer housing.

8. A housing system as defined in claim 7 wherein the inner housing is suspended within the outer housing.

9. A housing system as defined in claim 7, wherein the outer housing and the inner housing contain complementary guide strips and guide grooves which locate the inner housing within the outer housing.

10. A housing system as defined in claim 7, wherein the inner housing includes side walls and the side walls of the inner housing extend forward to define a housing for a trigger mechanism.

11. A housing system as defined in claim 7, wherein the inner housing includes side walls, and the side walls of the inner housing extend rearward to engage the outer housing.

12. A housing system as defined in claim 7, wherein the inner housing is plastic.

13. A housing system as defined in claim 7 wherein the inner housing is insertable into and removable from the outer housing via a rear opening in the outer housing.

14. A method of constructing a self-loading firearm comprising the steps of:

providing an inner housing defining a magazine chamber and a weapon housing having a rear end defining an opening; and positioning the inner housing within the weapon housing via the opening such that at least one force experienced by the weapon housing is transferred to the inner housing and so that damage from the at least one force occurs to the inner housing and not to the weapon housing.

15. A weapon housing comprising:

an outer housing having a rear end defining an opening;

an inner housing defining a magazine chamber and sized to be inserted into the outer housing via the opening.

16. A weapon housing comprising:

an outer housing;

an inner housing, wherein the inner housing is adapted to receive a trigger mechanism and a magazine cartridge.

17. For use with a self-loading firearm, a housing system comprising:

a magazine;

an inner housing defining a magazine chamber; and an outer housing having a first opening for receiving at least a portion of the magazine and a second, rearwardly oriented, opening for receiving the inner housing, the outer housing being dimensioned to removably receive the inner housing via the second opening, wherein when the inner housing is removed, the magazine cannot be secured in the first opening of the outer housing.

18. For use with a self-loading weapon, a housing system comprising:

a weapon housing having at least one wall at least partially encompassing a magazine chamber; and an inner housing located at least partially within the at least one wall, the inner housing at least partially encompassing at least a portion of the magazine chamber, wherein the weapon housing and the inner housing contain complementary guide strips and guide grooves which locate the inner housing within the weapon housing.

19. A housing system as defined in claim 18 wherein the complementary guide strips and guide grooves are adapted to transfer forces from the weapon housing to the inner housing.

20. For use with a self-loading weapon, a housing system comprising:

a weapon housing having at least one wall at least partially encompassing a magazine chamber; and an inner housing located at least partially within the at least one wall, the inner housing at least partially encompassing at least a portion of the magazine chamber, wherein the inner housing includes side walls and the side walls of the inner housing extend forward to define a housing for a trigger mechanism.

21. For use with a self-loading weapon, a housing system comprising:

a weapon housing having at least one wall at least partially encompassing a magazine chamber; and an inner housing located at least partially within the at least one wall, the inner housing at least partially encompassing at least a portion of the magazine chamber, wherein the inner housing includes side walls, and the side walls of the inner housing extend rearward to engage the weapon housing.

22. For use with a self-loading firearm having a magazine, a housing system comprising:

an inner housing defining a magazine chamber; and an outer housing surrounding the inner housing such that forces originating at the magazine are transferred from the inner housing to the outer housing, wherein the outer housing and the inner housing contain complementary guide strips and guide grooves which locate the inner housing within the outer housing.

23. For use with a self-loading firearm having a magazine, a housing system comprising:

an inner housing defining a magazine chamber; and an outer housing surrounding the inner housing such that forces originating at the magazine are transferred from the inner housing to the outer housing, wherein the inner housing includes side walls and the side walls of the inner housing extend forward to define a housing for a trigger mechanism.

24. For use with a self-loading firearm having a magazine, a housing system comprising:

an inner housing defining a magazine chamber; and an outer housing surrounding the inner housing such that forces originating at the magazine are transferred from the inner housing to the outer housing, wherein the inner housing includes side walls, and the side walls of the inner housing extend rearward to engage the outer housing.

25. For use with a self-loading firearm having a magazine, a housing system comprising:

an inner housing defining a magazine chamber; and an outer housing surrounding the inner housing such that forces originating at the magazine are transferred from the inner housing to the outer housing, wherein the inner housing is insertable into and removable from the outer housing via a rear opening in the outer housing.

* * * * *